United States Patent [19]

Petrillo et al.

[11] Patent Number: 5,066,156

[45] Date of Patent: Nov. 19, 1991

[54] WRITING INSTRUMENT CAP

[75] Inventors: Richard J. Petrillo, Norwell; William T. O'Connor, Somerville, both of Mass.

[73] Assignee: The Gillette Company, Boston, Mass.

[21] Appl. No.: 495,864

[22] Filed: Mar. 19, 1990

[51] Int. Cl.[5] ..... B43K 5/00; B43K 9/00

[52] U.S. Cl. ..... 401/213; 401/202; 401/243; D19/57

[58] Field of Search ..... 401/202, 213, 243; D19/57

[56] References Cited

U.S. PATENT DOCUMENTS

| | | | |
|---|---|---|---|
| 4,627,757 | 12/1986 | Manusch et al. | 401/202 X |
| 4,844,642 | 7/1989 | Inaba | 401/202 X |
| 4,915,529 | 4/1990 | List | 401/202 |
| 4,969,766 | 11/1990 | Nagle et al. | 401/202 |

FOREIGN PATENT DOCUMENTS

| | | | |
|---|---|---|---|
| 2818477 | 10/1979 | Fed. Rep. of Germany | 401/202 |
| 6111016 | 6/1983 | Japan | 401/213 |
| 835559 | 5/1960 | United Kingdom . | |
| 2174374 | 11/1986 | United Kingdom . | |
| 2215279 | 9/1989 | United Kingdom | 401/202 |
| 2218381 | 11/1989 | United Kingdom . | |
| 2226199 | 1/1990 | United Kingdom | 401/213 |

*Primary Examiner*—Richard J. Apley
*Assistant Examiner*—D. F. Crosby

[57] ABSTRACT

A writing instrument cap which can provide a substantially air-tight seal about a point or nib carried by the barrel of a writing instrument and which also includes passageways which permit air to flow through internal regions of the cap.

10 Claims, 2 Drawing Sheets

WRITING INSTRUMENT CAP

BACKGROUND OF THE INVENTION

Part 1. The Field of the Invention.

This invention relates to novel improved caps for writing instruments. More precisely, the invention relates to caps for writing instruments which can provide a substantially air-tight seal about the nib or point carried by the barrel of instrument and which also provides means to permit air to flow through the cap.

Part 2. Description of the Prior Art.

Caps for writing instruments such as markers or pens are well known to the art. Essentially, such caps are designed to provide a substantially air-tight seal about the nib or point of the instrument to prevent dry-out and also to protect the nib or point from physical damage. Unfortunately, a writing instrument cap designed to provide an air-tight seal can also present a potential threat to safety since the cap can block passage of air if swallowed. The industry has been actively engaged in programs designed to develop caps which would eliminate or at least minimize this potential safety threat. For example, caps which include a clip protruding outwardly along a major portion of the cap surface length are believed to reduce the threat since the protruding clip may provide a passageway for air. Also, U.K. Patent 2,174,374 discloses a cap which includes ribs which provide passageways arranged about the exterior of the cap. However, despite such developments, the need remains for caps which can be produced in high volumes at relatively low costs and have the combined capability to provide an air-tight seal about the point or nib and also permit passage of air through internal regions of the cap.

SUMMARY OF THE INVENTION

The writing instrument caps of the present invention include a tubular outer cap shell member having open front and rear ends. A tip seal member having an open front end and a closed rear end is positioned in the internal central region of the cap shell member and is securely attached to the rear end of the cap shell member. A plurality of ribs extend between the outer surface of the tip seal member and the inner surface of the cap shell member to form a plurality of adjacent passages between the cap shell and tip seal members so that air can pass through the passages from the front to the rear end of the cap shell member. In the preferred caps of the invention, the open front end of the tip seal member is adapted to provide a substantially air-tight seal about the barrel end portion of a marking instrument holding a nib or point. Additionally, preferred caps include openings in the ribs forming the passageways so that air can move from one passageway to an adjacent passageway.

DETAILED DESCRIPTION OF THE INVENTION

Figure 1:
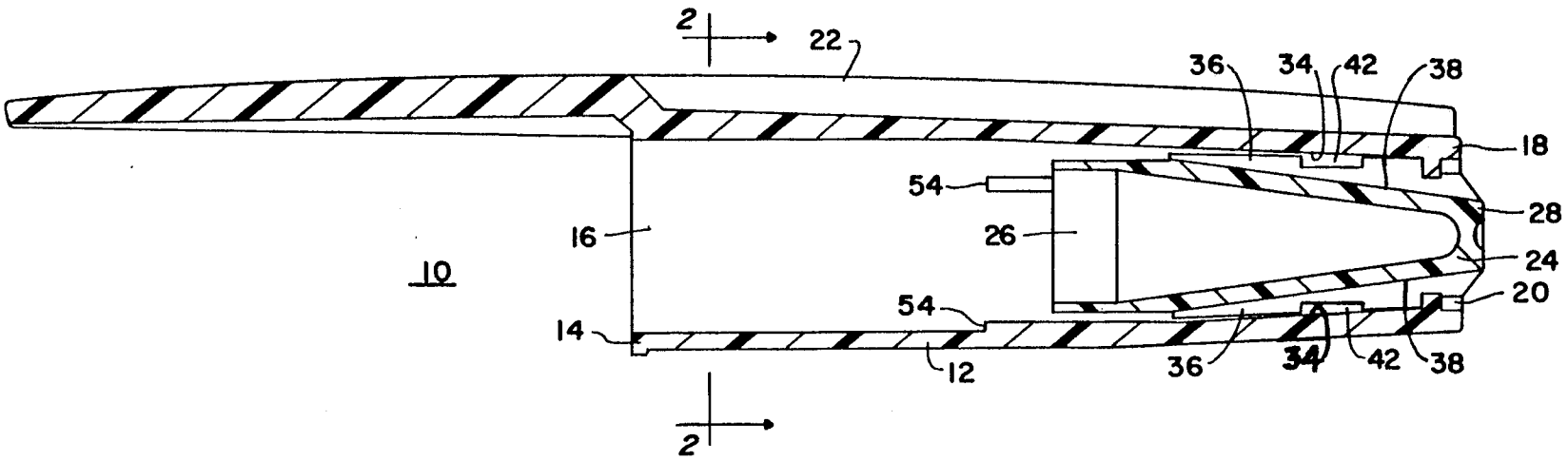
FIG. 1 is a cross-sectional view of a cap of the present invention.
Figure 3:
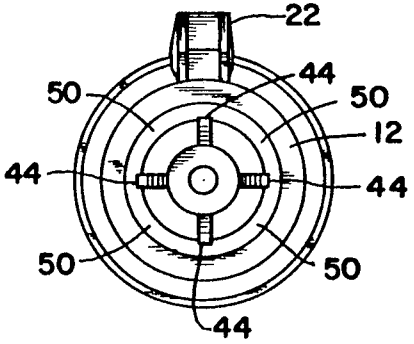
FIG. 3 is an end view of a cap of the present invention.
Figure 2:
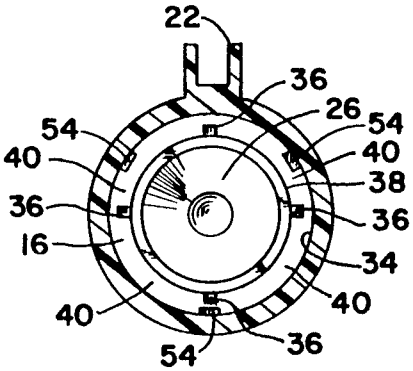
FIG. 2 is a view of a cap of the present invention along lines 2—2 of FIG. 1.
Figure 4:
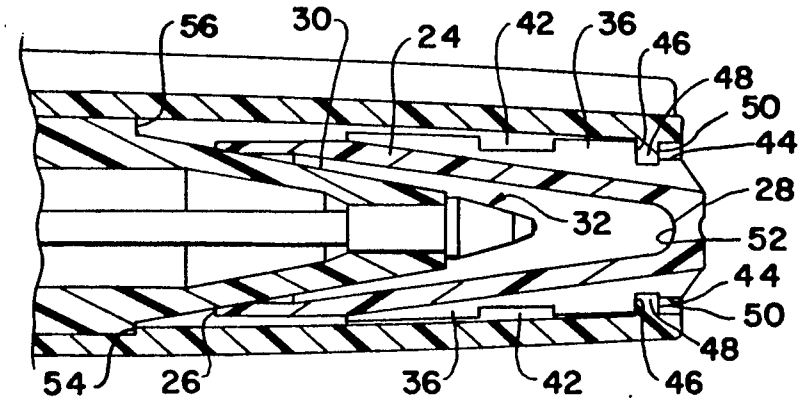
FIG. 4 is a partial cross-sectional view of a cap of the present invention secured to a writing instrument.

Referring first to FIGS. 1–3, cap 10 is formed of a substantially vapor impermeable, moldable polymeric material such as a polyethylene or polypropylene and includes outer shell member 12 which is preferably circular in shape. Member 12 has front end 14 providing front opening 16 and rear end 18 providing rear opening 20. Member 12 preferably includes clip 22 and clip 22 extends along a major portion of the length of member 12 and preferably extends beyond the length of member 12 as shown. Cap 10 also includes integral tip seal member 24 which is also formed of a substantially vapor impermeable, moldable polymeric material. In the preferred practice of the invention, shell member 12 and tip seal member 24 are individually molded parts and are assembled in the manner described hereinafter. However, shell 12 and tip seal member 24 can be unitary elements of cap 10 formed by way of a single molding operation. Tip seal member 24 includes open front end 26 and closed rear end 28 and is fixedly positioned in the central region of shell member 12 near end 18. Open front end 26 of tip seal member 24 is adopted to retain the end of a writing instrument barrel 30 (FIG. 4) carrying a point 32 (or a nib) and to provide a substantially air-tight seal about the point or nib to effectively prevent dry-out of the point or nib and to protect the point or nib.

Tip seal member 24 is spaced apart from inner surface 34 of outer shell member 12 by a plurality of ribs 36 which are carried about surface 38 of member 24. Ribs 36 are arranged to extend longitudinally along a portion of surface 38 between surface 38 of member 24 and inner surface 34 of member 12. In this way, ribs 36 form a plurality of adjacent passageways 40 which permit passage of a large volume of air from front opening 16 to rear opening 20. In the preferred embodiments of the invention, at least one rib 36 includes opening(s) 42 (FIG. 1) which permit passage of air from one passage to the adjacent passages. Preferably, all ribs include openings 42. As mentioned, shell member 12 and tip seal member 24 are molded separately and assembled together in the preferred practice of the invention. Accordingly, tip seal member 24 includes locking means for securely attaching member 24 to rear end 18 of shell member 12. Preferred locking means include a plurality of teeth 44 (FIGS. 3 and 4) which are arranged about top 28 of seal member 24 in alignment with but spaced apart from top surfaces 46 (FIG. 4) of ribs 36. Teeth 44 are sufficiently resiliant (or deformable) so that they can be pushed through flange 48 to engage top surface 50 of flange 48 with a snap lock fit after passage through flange 48. In this way, tip seal member 24 is securely locked about flange 48 by teeth 44 and top surface(s) 46 of rib(s) 36. In the preferred embodiments of the invention, the inside diameter of front end 26 of tip seal member 24 is selected to provide a close friction fit about the outside diameter of writing instrument barrel 30. Additionally, end 26 is preferably deformable so that it can expand slightly on engagement with leading end portions of barrel 30 as point 32 (or nib) is pushed toward inner end surface 52 of seal member 24. In this way seal member 24 provides a substantially air-tight seal about leading end portions of barrel 30. Ribs 36 which provide passageways 40 also cooperate to provide support for seal member 24 as the leading end portions engage front end 26 and is pushed toward inner end surface 52. Also, the preferred caps include a plurality of positive stops 54 (FIGS. 1 and 4) arranged about inner surface 34 for abutment against edge 56 of barrel 30 as edge 56 is moved toward end surface 52. Usually three or four stops 54 are employed (See FIG. 2).

In preferred caps of the invention, the overall length of shell member 12 is about 40 mm while the overall length of clip 22 is about 30 mm. The OD and ID of front end 14 of shell member 12 are about 11.60 and 9.44 mm respectively. Tip seal member 24 has an overall length of about 20.65 mm and the OD and ID of open end 26 are about 7.40 and 6.40 mm respectively. Preferred caps include four ribs including two segments having a thickness of about 1.50 mm and an overall length of about 20.65 mm and separated from each other by an opening 40 having a length of about 2.50 mm. Caps described above permit a minimum air flow of 8 L/min. with a maximum pressure drop of 1.33 kP.

In the especially preferred caps of the invention, the dimensions of front end 26 and of leading end portions of barrel 30 are selected to provide a friction fit between the leading end portion and end 26 of number 24 when edge 56 abuts stop(s) 54. Additionally, teeth 44 and surface 46 of ribs 36 are so dimensioned that they are locked about flange 48 but are also slidable about flange 48. In this way, rotation of barrel 30 causes rotation of member 24 and this rotation can be observed at end 18 to signal the achievement of a substantially air tight seal between front end 26 and the leading end portions of barrel 30.

From the foregoing description, it will be apparent that the invention presents to the art an improved cap for writing instruments. The preferred caps comprise two relatively inexpensive members which can be produced and assembled using high speed, high volume processes and apparatus. Moreover, the caps have the capability to consistently provide substantially air tight seals about the pen nib or point coupled with the capability to permit effective air flow through the cap. Accordingly, the caps present to the art a distinctive combination of design and functional features which are different from those presented by caps known at the time the present invention was made.

What is claimed is:

1. A cap for a writing instrument comprising an outer shell member providing open front and rear ends, a tip seal member having an open front end and a closed rear end, said tip seal member being fixedly positioned substantially within an internal central region of the shell member at the rear end of the shell member to prevent longitudinal movement of said tip seal within said shell member, said outer shell member and tip seal member being separated from each other by a plurality of elongated ribs extending longitudinally between the outer surface of the tip seal member and the inner surface of the shell member to provide a plurality of passageways for air flow between the front and rear ends of the outer shell member, said elongated ribs connecting said tip seal member to said shell member at said rear end of said shell member.

2. A cap of claim 1 including a clip extending longitudinally along a major portion of the outer surface of the shell member.

3. A cap of claim 2 where the clip further extends beyond the overall length of the cap.

4. A cap of claim 1 where at least one rib provides an opening to permit the passage of air from a passageway to an adjacent passageway.

5. A cap of claim 1 wherein the tip seal member is a molded unitary member which includes locking means to securely attach the tip seal member to the rear end of the outer shell member.

6. A cap of claim 5 wherein the locking means comprise a plurality of teeth arranged about the closed rear end of the tip seal member and in alignment with but spaced apart from the ribs and adapted for insertion through a flange fixed to the open rear end of the shell member to lock the tip member to the flange between the teeth and the ribs.

7. A cap for a writing instrument comprising an outer shell member providing open front and rear ends, a tip seal member having an open front end and a closed rear end, said tip seal member being fixedly positioned in the internal central region of the shell member near the rear end of the shell member, said outer shell member and tip seal member being separated from each other by a plurality of ribs longitudinally between the outer surface of the tip seal member and the inner surface of the shell member to provide a plurality of passageways for air flow between the front and rear ends of the outer shell member;

wherein the tip seal member includes a plurality of teeth arranged about the closed rear end of the tip seal member spaced apart from the ribs and adapted for insertion through a flange fixed to the open rear end of the shell member to lock the tip member to the flange between the teeth and the ribs and prevent longitudinal movement of said tip seal within said shell member.

8. The cap of claim 7 wherein the teeth are in alignment with the ribs.

9. The said cap of claim 7 where the teeth and ribs are slideably locked about said flange.

10. A cap for a writing instrument comprising an outer shell member providing open front and rear ends, a tip seal member having an open front end and a closed rear end, said tip seal member being fixedly positioned in the internal central region of the shell member near the rear end of the shell member, said outer shell member and tip seal member being separated from each other by a plurality of ribs longitudinally between the outer surface of the tip seal member and the inner surface of the shell member to provide a plurality of passageways for air flow between the front and rear ends of the outer shell member, where at least one rib provides an opening to permit the passage of air from a passageway to an adjacent passageway.

* * * * *